US008570125B2

(12) United States Patent
Suzuki et al.

(10) Patent No.: US 8,570,125 B2
(45) Date of Patent: Oct. 29, 2013

(54) ELECTROMAGNETIC SWITCH

(75) Inventors: Kenji Suzuki, Kounosu (JP); Yasuhiro Naka, Kounosu (JP); Kouetsu Takaya, Kounosu (JP); Yuichi Yamamoto, Kounosu (JP); Yuji Shiba, Kounosu (JP)

(73) Assignee: Fuji Electric FA Components & Systems Co., Ltd., Tokyo (JP)

( * ) Notice: Subject to any disclaimer, the term of this patent is extended or adjusted under 35 U.S.C. 154(b) by 0 days.

(21) Appl. No.: 13/519,782

(22) PCT Filed: Jun. 14, 2011

(86) PCT No.: PCT/JP2011/003382

§ 371 (c)(1),
(2), (4) Date: Aug. 7, 2012

(87) PCT Pub. No.: WO2012/029219

PCT Pub. Date: Mar. 8, 2012

(65) Prior Publication Data

US 2012/0326815 A1 Dec. 27, 2012

(30) Foreign Application Priority Data

Aug. 31, 2010 (JP) ..... 2010-194464

(51) Int. Cl.
*H01H 3/00* (2006.01)

(52) U.S. Cl.
USPC ..... 335/185; 335/131

(58) Field of Classification Search
USPC ..... 335/201
See application file for complete search history.

(56) References Cited

U.S. PATENT DOCUMENTS

| | | | | |
|---|---|---|---|---|
| 5,519,370 | A | 5/1996 | Perreira et al. | |
| 5,877,464 | A * | 3/1999 | Moldovan | 218/29 |
| 6,700,466 | B1 * | 3/2004 | Yamamoto et al. | 335/132 |
| 6,975,194 | B2 * | 12/2005 | Nishida et al. | 335/132 |
| 2009/0315653 | A1 * | 12/2009 | Suzuki et al. | 335/185 |

FOREIGN PATENT DOCUMENTS

| | | | |
|---|---|---|---|
| JP | S51-160143 | U | 12/1976 |
| JP | H11-191352 | A | 7/1999 |
| JP | 2006-019148 | A | 1/2006 |
| JP | 2006-216438 | A | 8/2006 |

* cited by examiner

*Primary Examiner* — Elvin G Enad
*Assistant Examiner* — Lisa Homza
(74) *Attorney, Agent, or Firm* — Manabu Kanesaka

(57) ABSTRACT

An electromagnetic switch has a contact device having a pair of fixed contacts fixed thereof and maintaining a predetermined interval inside an arc-extinguishing chamber receptacle, and a movable contact disposed to be connectable with the pair of fixed contacts; and an electromagnetic device driving the movable contact. The electromagnetic device has a cylindrical exciting coil, a fixed core passing through center of the exciting coil, a magnetic yoke covering an outer side of the exciting coil, and a movable core facing the fixed core and the magnetic yoke, and armature surfaces of the fixed core and the magnetic yoke are formed on a side of the contact device than the exciting coil.

8 Claims, 2 Drawing Sheets

ELECTROMAGNETIC SWITCH

RELATED APPLICATIONS

The present application is National Phase of International Application No. PCT/JP2011/003382 filed Jun. 14, 2011, and claims priority from Japanese Application No. 2010-194464, filed Aug. 31, 2010.

TECHNICAL FIELD

The present invention relates to an electromagnetic switch including a contact device that has fixed contacts and a movable contact inserted in a current path, and an electromagnet that drives the movable contact.

BACKGROUND ART

As this kind of electromagnetic switch, there is proposed, for example, a hermetic type relay device wherein a spatial cavity is formed by a ring-like core base upper portion, a ring-like core base bottom portion, and a core external wall linking outer peripheral edges of the core base upper portion and core base bottom portion, and an exciting coil is mounted inside the spatial cavity. Also, a core assembly is formed by inserting a cylindrical core center through a central aperture in the core base upper portion, a bottomed cylindrical member is fitted onto the outer peripheral portion of the core center, a movable plunger that opposes the lower surface of the core center across a predetermined gap is disposed inside the bottomed cylindrical member, and an armature shaft that extends upward through the core center and holds a movable contact is fixed in the plunger (for example, refer to Patent Document 1).

Also, there is proposed an electromagnetic switching device that has a configuration wherein a first yoke and second yoke having cylindrical portions individually fitted inside a cylindrical portion of the bobbin on an upper portion side and lower portion side of a bobbin having flange portions, and flange portions formed on the outer side of the cylindrical portions, are disposed at both ends of a cylindrical, portion in which an exciting coil is wound, a movable core is slidably disposed on the inner peripheral surface of the second yoke, and a movable contact is held in the movable core via a connecting shaft (for example, refer to Patent Document 2).

RELATED ART DOCUMENTS

Patent Documents

Patent Document 1: Japanese Patent Publication JP-T-9-510040

Patent Document 2: Japanese Patent publication JP-A-2006-19148

OUTLINE OF THE INVENTION

Problems to be Solved by the Invention

However, in the heretofore known example described in the heretofore mentioned Patent Document 1, an armature surface of the core center, which is a fixed iron core, and an armature surface of the plunger, which is a movable iron core, are disposed facing each other across the predetermined gap on the inner peripheral side of the exciting coil, and the bottomed cylindrical member fitted onto the outer peripheral surface of the core center is necessary in order to guide the movable core. When disposing the armature surfaces of the fixed core and movable core on the central side of the exciting coil in this way, there is an unsolved problem in that it is not possible to simultaneously satisfy the two requirements of enlarging the armature surface area and increasing the coil winding volume of the exciting coil, which are requirements for efficiently outputting an attractive force with a small stroke. That is, when enlarging the armature surface area, it is necessary to increase the inner diameter of a bobbin in which the exciting coil is wound, because of which the coil winding volume decreases. Conversely, when reducing the inner diameter of the bobbin in order to increase the coil winding volume, it is no longer possible to ensure the armature surface area between the fixed core and movable core, and there is a trade-off relationship between enlarging the armature surface area and increasing the coil winding volume. Because of this, there is an unsolved problem in that it is not possible to efficiently output an attractive force with a small stroke.

Also, as the bottomed cylindrical member is necessary in order to guide the movable core, the number of parts increases, and there is an unsolved problem in that the manufacturing cost increases, and the like, because, as well as it being necessary that the inner diameter dimension of the bottomed cylindrical member is of a high accuracy, the bottomed cylindrical member is formed by a special drawing process.

Also, in the heretofore known example described in Patent Document 2, while there is no need for a special bottomed cylindrical member, there is an unsolved problem in that, as well as it being necessary that the inner diameter dimension of the second yoke is of a high accuracy because the movable core is guided by the second yoke, there is a trade-off relationship between enlarging the armature surface area and increasing the coil winding volume, as in the heretofore known example described in the previously described Patent Document 1, and it is not possible to efficiently output an attractive force with a small stroke.

Therefore, the invention, having been contrived focusing on the unsolved problems of the heretofore known examples mentioned above, has an object of providing an electromagnetic switch with which it is possible to efficiently output an attractive force with a small stroke, with no need to form a guide way that guides a movable iron core inside an exciting coil.

Means for Solving the Problems

In order to achieve the above-mentioned object, a first aspect of an electromagnetic switch according to the invention includes a contact device having a pair of fixed contacts fixed to maintain a predetermined interval inside an arc-extinguishing chamber receptacle and a movable contact disposed to be contactable with the pair of fixed contacts, and an electromagnetic device driving the movable contact. The electromagnetic device has a cylindrical exciting coil, a fixed iron core passing through the center of the exciting coil, a magnetic yoke covering the outer side of the exciting coil, and a movable core facing the fixed core and magnetic yoke, and armature surfaces of the fixed core and magnetic yoke are formed on the contact device side of the exciting coil.

According to this configuration, as the armature surfaces of the fixed core and magnetic yoke are formed on the contact device side of the exciting coil, there is no need to provide a movable core inside the exciting coil, and it is possible to increase the armature surface area while increasing the coil winding volume.

Also, a second aspect of the electromagnetic switch according to the invention has a configuration wherein three or more armature surfaces are formed on the fixed core and magnetic yoke.

According to this configuration, as three or more armature surfaces are formed on the fixed core and magnetic yoke, it is possible to easily carry out an increase of the armature surface area.

Also, a third aspect of the electromagnetic switch according to the invention is such that the fixed core is formed in a T-shape from a rod portion inserted through the exciting coil and a plate portion covering the contact device side end portion of the exciting coil connected to the contact device side end portion of the rod portion, and the magnetic yoke has two or more facing plate portions facing at least two end portions of the plate portion of the fixed core across a magnetic gap.

According to this configuration, it is possible to form one armature surface configuring a magnetic circuit with the plate portion of the fixed core on the contact device side of the exciting coil, and to form the other two or more armature surfaces with the facing plate portions of the magnetic yoke, and it is thus possible to increase the armature surface area while increasing the coil winding volume.

Also, a fourth aspect of the electromagnetic switch according to the invention is such that the facing plate portions of the magnetic yoke are covered by a non-magnetic member.

According to this configuration, it is possible to cause the facing plate portions of the magnetic yoke to face the movable core across a non-magnetic gap, and thus possible to ensure a characteristic of release when the contact device is opened.

Also, a fifth aspect of the electromagnetic switch according to the invention is such that the non-magnetic member is configured of the arc-extinguishing chamber receptacle.

According to this configuration, as there is no need to prepare a separate non-magnetic member, it is possible to reduce the number of parts.

Also, a sixth aspect of the electromagnetic switch according to the invention has a structure wherein the movable core is urged to the contact device side by a return elastic body, and guided ascendably and descendably by a guide member, and a contact holder holding the movable contact is formed.

According to this configuration, it is possible to guide the movable core to ascend and descend inside the arc-extinguishing chamber receptacle using a guide member.

Advantage of the Invention

According to the invention, as the armature surfaces of the movable core and fixed core of the electromagnetic device are formed on the contact device side of the exciting coil, no movable core is disposed in the central portion of the exciting coil; therefore, there is no need to provide a guide member that guides the movable core. In other words, it is possible to reduce the number of parts accordingly. It is also sufficient to dispose only a fixed core on the central side of the exciting coil without providing an armature surface so that an advantage is obtained in that it is possible to increase the winding volume of the exciting coil, and furthermore, it is possible to ensure a large armature surface area between the fixed core and movable core, and efficiently output an attractive force with a small stroke.

MODE FOR CARRYING OUT THE INVENTION

Hereafter, a description will be given, based on the drawings, of an embodiment of the invention.

Figure 1:
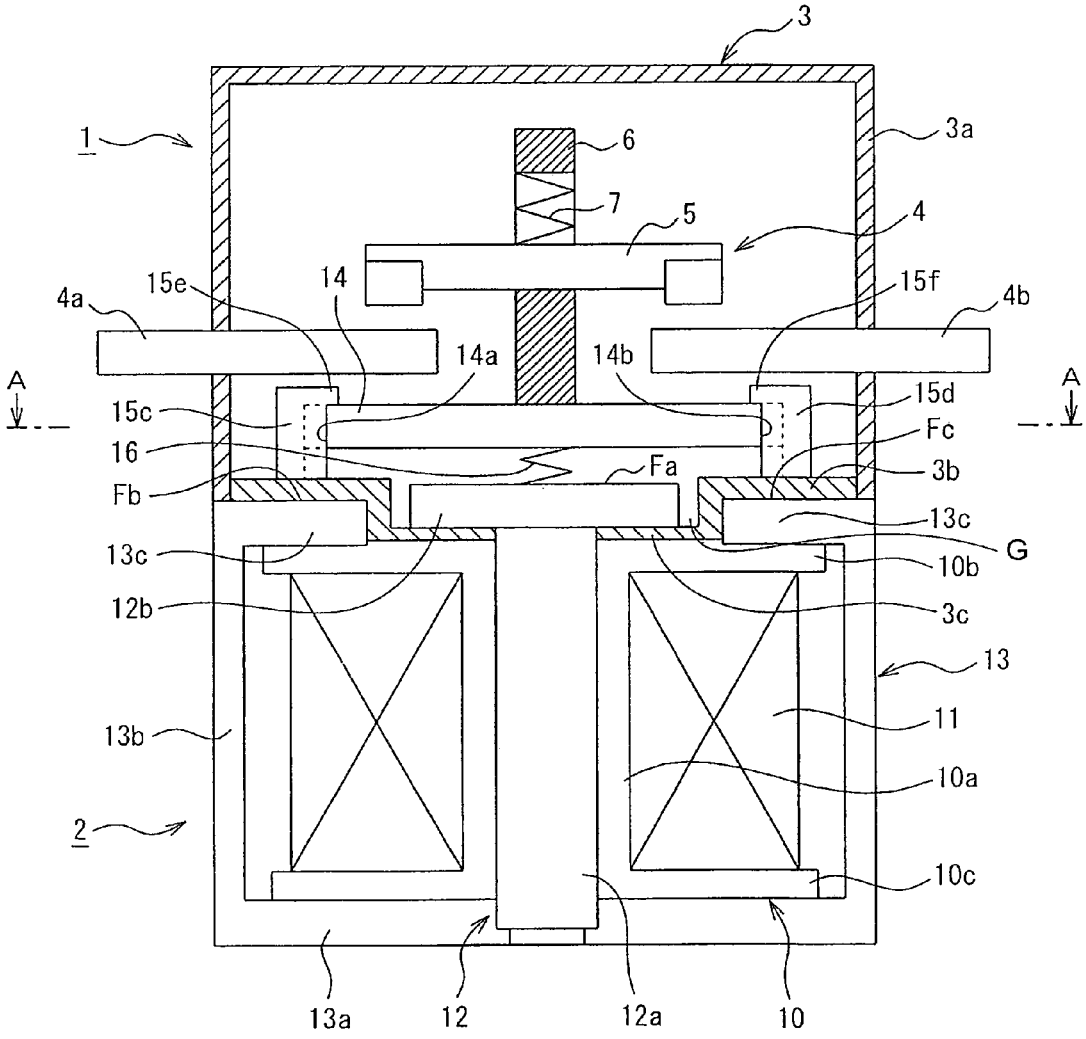
FIG. 1 is a sectional view showing an embodiment of a case in which the invention is applied to an electromagnetic contactor.

FIG. 1 is a sectional view showing an example of a case in which a contact device of the invention is applied to an electromagnetic contactor acting as an electromagnetic switch. In FIG. 1, reference numeral 1 is a contact device, and a direct current operated electromagnetic device 2 is disposed on the lower surface side of the contact device 1.

The contact device 1 has an arc-extinguishing chamber receptacle 3 of, for example, a non-ferrous metal, synthetic resin, or the like, which is non-magnetic and on which an insulating process has been carried out, and a contact mechanism 4 is disposed inside the arc-extinguishing chamber receptacle 3. The arc-extinguishing chamber receptacle 3 is configured of a bottomed cylindrical body 3*a*, whose lower end surface is opened, and a bottom plate portion 3*b* that closes off the lower end surface of the bottomed cylindrical body 3*a*. The bottom plate portion 3*b* has a protruding portion 3*c* that protrudes downward in a central portion thereof, and an insertion hole 3*d* through which is inserted a shaft portion 12*a* of a fixed iron core 12, to be described hereafter, is formed in a central position of the protruding portion 3*c*.

The contact mechanism 4 is configured of fixed contacts 4*a* and 4*b* and a movable contact 5. The fixed contacts 4*a* and 4*b* are fixed to and supported by facing wall surfaces of the bottomed cylindrical body 3*a* of the arc-extinguishing chamber receptacle 3, with inner ends thereof separated by a predetermined distance, and outer ends thereof protruding to the exterior of the arc-extinguishing chamber receptacle 3.

Also, the movable contact 5 is formed in a plate form, and is disposed facing the upper end sides of the fixed contacts 4*a* and 4*b* at a predetermined distance to be contactable therewith. The movable contact 5 is installed in a contact holder 6, which is urged downwards by a contact spring 7.

Also, the electromagnetic device 2 is disposed on the lower surface side of the arc-extinguishing chamber receptacle 3. The electromagnetic device 2 includes a coil bobbin 10 configured of a cylindrical portion 10*a*, whose axial direction is an up-down direction, and flange portions 10*b* and 10*c* protruding outward from both ends of the cylindrical portion 10*a*. An exciting coil 11 is installed wound in a cylindrical space of the coil bobbin 10 surrounded by the cylindrical portion 10*a* and flange portions 10*b* and 10*c*.

Also, the fixed core 12 is inserted through the interior of the cylindrical portion 10*a* of the coil bobbin 10. The fixed core 12 is configured in a T-form by the shaft portion 12*a* inserted through the cylindrical portion 10*a* of the coil bobbin 10 and a plate portion 12*b* extending in a direction perpendicular to the shaft from the upper end, which is the contact device 1 side, of the shaft portion 12*a*. Herein, the upper surface of the plate portion 12*b* is set so as to be in a position lower than the upper surface of the bottom plate portion 3*b* of the arc-extinguishing chamber receptacle 3.

Also, a magnetic yoke 13 is disposed on the exterior of the coil bobbin 10. The magnetic yoke 13 is configured of a bottom plate portion 13*a* that supports the flange portion 10*c*, a cylindrical portion 13*b* extending upward from the outer peripheral edge of the bottom plate portion 13*a*, and a pair of flange portions 13*c* as facing plate portions inward from the upper end of the cylindrical portion 13*b* that oppose the outer ends of the plate portion 12*b* of the fixed core 12 across a predetermined gap G.

Then, the plate portion 12*b* of the fixed core 12 is fixed to the interior of the previously described protruding portion 3*c* formed on the bottom plate portion 3*b* of the arc-extinguishing chamber receptacle 3, and the upper surface of the flange portion 13*c* of the magnetic yoke 13 contacts the lower surface of the outer side of the protruding portion 3*c* on the bottom plate portion 3*b* of the arc-extinguishing chamber receptacle 3. That is, the upper surface of the flange portion 13*c* of the magnetic yoke 13 is covered by the bottom plate portion 3*b* of the arc-extinguishing chamber receptacle 3, and a non-magnetic gap is formed.

Figure 2:
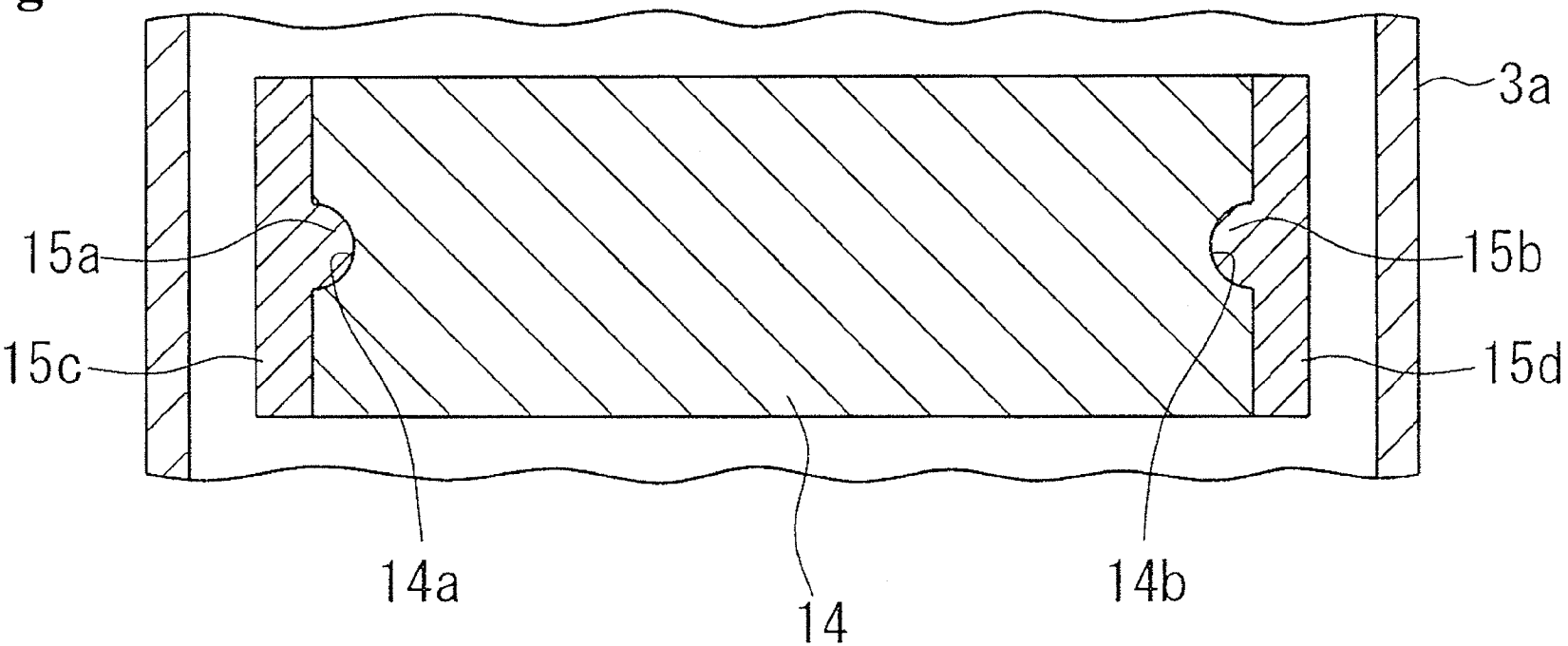
FIG. 2 is a sectional view along the line A-A of FIG. 1.

Then, inside the arc-extinguishing chamber receptacle 3, a movable iron core 14, movable in an up-down direction, is disposed so as to oppose the plate portion 12*b* of the fixed core 12 and flange portion 13*c* of the magnetic yoke 13 of the electromagnetic device 2 from above. The movable core 14 is formed in a plate form, and depressed guide portions 14*a* and 14*b* of, for example, a semi-circular form in cross-section are formed one each in both the front and rear end portions of the movable core 14, as shown in FIG. 2. The depressed guide portions 14*a* and 14*b* are guided in an up-down direction by guide members 15*c* and 15*d*, formed protruding above the bottom plate portion of the arc-extinguishing chamber receptacle 3, on which are formed protruding guide portions 15*a* and 15*b* of a semi-circular form in cross-section that engage with the front and rear pair of depressed guide portions 14*a* and 14*b*.

Also, a return spring 16 acting as a return elastic member is disposed between the upper surface of the fixed core 12 and lower surface of the movable core 14, and the movable core 14 is urged by the return spring 16 in a direction such that it is separated upwardly from the plate portion 12*b* of the fixed core 12. Then, an upward position of the movable core 14 is restricted by latching pieces 15*e* and 15*f* formed on upper portions of the guide members 15*c* and 15*d*, as shown in FIG. 1.

Then, the contact holder 6 extending upward between the previously described fixed contacts 4*a* and 4*b* is fixed in a central portion of the upper surface of the movable core 14.

In the embodiment, the plate portion 12*b* of the fixed core 12, and the pair of flange portions 13*c* of the magnetic yoke 13 facing both the left and right direction end portions of the plate portion 12*b* in a horizontal direction across the predetermined gap, are disposed on the outer side of the contact device 1 side of the exciting coil 11 of the electromagnetic device 2. Consequently, the plate portion 12*b* of the fixed core 12 forms one armature surface Fa configuring a magnetic circuit, and the pair of flange portions 13*c* of the magnetic yoke 13 form two armature surfaces Fb and Fc, which are other armature surfaces.

Next, a description will be given of an action of the heretofore described embodiment.

Now, when the exciting coil of the electromagnetic device 2 is in a non-conducting condition wherein no direct current is supplied, no magnetic flux flows through the magnetic circuit formed by the fixed core 12 and magnetic yoke 13, and a condition is such that no attractive force works at the three armature surfaces Fa, Fb, and Fc formed by the fixed core 12 and pair of flange portions 13*c* of the magnetic yoke 13.

Because of this, the movable core 14 is urged by the return spring 16 in an upward direction away from the plate portion 12*b* of the fixed core 12, and the upward position is restricted by the upper surface of the movable core 14 coming into contact with the latching pieces 15*e* and 15*f* formed on the upper surfaces of the guide members 15*c* and 15*d*.

In this condition, a gap of in the region of, for example, 2 mm is formed between the upper surface of the plate portion 12*b* of the fixed core 12 and the lower surface of the movable core 14. At this time, the movable contact 5 held in the contact holder 6 formed in the movable core 14 is urged downward by the contact spring 7, but the movable contact 5 and fixed contacts 4*a* and 4*b* are also separated by in the region of 2 mm, the contact device 1 is in an opened condition, and there is a power gating condition wherein power supplied to the one fixed contact 4*a* is not supplied to the fixed contact 4*b* side.

On energizing the exciting coil 11 in the opened condition of the contact device 1, a magnetic flux flows through the magnetic circuit formed by the fixed core 12 and magnetic yoke 13 surrounding the exciting coil 11, and an attractive force is generated at the three armature surfaces Fa, Fb, and Fc formed by the fixed core 12 and the pair of flange portions 13*c* of the magnetic yoke 13, attracting the movable core 14 downward against the return spring 16.

Because of this, the movable core 14 moves downward, contacting with the upper surface of the bottom plate portion 3*b* of the arc-extinguishing chamber receptacle 3, and the lower surface of the movable core 14 faces the pair of flange portions 13*c* of the magnetic yoke 13 across the non-magnetic gap formed by the bottom plate portion 3*b* of the arc-extinguishing chamber receptacle 3. At this time, the movable contact 5 held in the contact holder 6 formed in the movable core 14 also moves downward, and contacts between the fixed contacts 4*a* and 4*b* with a contact pressure generated by the contact spring 7. Because of this, the fixed contacts 4*a* and 4*b* have continuity owing to the movable contact 5, and the contact device 1 is in a closed condition.

On the energizing of the exciting coil 11 being stopped in the closed condition of the contact device 1, the attractive force at the armature surfaces Fa, Fb, and Fc of the fixed core 12 and the pair of flange portions 13*c* of the magnetic yoke 13 of the electromagnetic device 2 disappears. Because of this, the movable core 14, owing to the return spring 16, moves upward away from the armature surfaces Fa, Fb, and Fc formed by the fixed core 12 and the flange portions 13*c* of the magnetic yoke 13. Because of this, the movable contact 5 moves upward, away from between the fixed contacts 4*a* and 4*b*, and the contact device 1 returns to the opened condition.

In this way, according to the heretofore described embodiment, the armature surfaces Fa, Fb, and Fc formed by the fixed core 12 and the pair of flange portions 13*c* of the magnetic yoke 13 of the electromagnetic device 2 are formed on the contact device 1 side of the coil bobbin 10 in which the exciting coil 11 is wound. Because of this, as the shaft portion 12*a* of the fixed core 12 is merely inserted through the exciting coil 11, and no movable portion exists, there is no need to dispose a guide member in the exciting coil 11, and it is possible to reduce the number of parts accordingly.

Moreover, as it is sufficient that the shaft portion 12*a* of the fixed core 12 inserted through the exciting coil 11 forms a flux path, there is no need for a large sectional area, and it is possible to ensure a sufficient winding volume of the exciting coil 11 wound in the coil bobbin 10 with a reduced inner diameter of the cylindrical portion 10*a* of the coil bobbin 10, and to ensure a magnetic flux.

In addition to this, as the three armature surfaces Fa, Fb, and Fc formed by the fixed core 12 and the pair of flange portions 13*c* of the magnetic yoke 13 are formed on the contact device 1 side of the coil bobbin 10, no trade-off with the coil winding volume arises, and it is possible to ensure a large armature surface area, it is possible to efficiently output an attractive force by the electromagnetic device 2 with a small stroke.

Also, as it is possible to utilize the bottom plate portion 3*b* of the arc-extinguishing chamber receptacle 3 as the non-magnetic gap necessary in order to ensure release characteristics of the movable contact 5 that change the closed condition of the contact device 1 to the opened condition, there is no need to form a separate non-magnetic gap, and it is possible here too to reduce the number of parts accordingly. At this time, even when increasing the thickness of the arc-extinguishing chamber receptacle 3 in order to ensure the strength of the arc-extinguishing chamber receptacle 3, it is possible, by forming the plate portion 12*b* of the fixed core 12 in the arc-extinguishing chamber receptacle 3 as previously described, to reduce magnetic resistance, and ensure necessary magnetic characteristics.

In the heretofore described embodiment, a description has been given of a case wherein the plate portion 12*b* of the fixed core of the electromagnetic device 2 is disposed in the arc-extinguishing chamber receptacle 3 but, this not being limited, the plate portion 12*b* of the fixed core 12 may be disposed outside the arc-extinguishing chamber receptacle 3 when it is possible to reduce magnetic resistance by reducing the thickness of the arc-extinguishing chamber receptacle 3.

Also, in the heretofore described embodiment, a description has been given of a case wherein the two armature surfaces Fb and Fc are formed on the magnetic yoke 13 but, this not being limited, three or more armature surfaces may be formed by also providing the flange portion 13*c* of the magnetic yoke 13 on another surface facing the plate portion 12*b* of the fixed core 12.

Furthermore, in the heretofore described embodiment, a description has been given of a case wherein the invention is applied to an electromagnetic contactor but, this not being limited, it is possible to apply the invention to another electromagnetic switch, such as an electromagnetic relay.

INDUSTRIAL APPLICABILITY

With the invention, as the armature surfaces of the movable core and fixed core of the electromagnetic device are formed on the contact device side of the exciting coil, it is possible to reduce the number of parts and increase the winding volume of the exciting coil, and furthermore, it is possible to provide an electromagnetic switch with which an attractive force can be effectively output with a small stroke.

DESCRIPTION OF REFERENCE NUMERALS AND SIGNS

1 Contact device
2 Electromagnetic device
3 Arc-extinguishing chamber receptacle
3*a* Bottomed cylindrical body
3*b* Bottom plate portion
3*c* Protruding portion
4*a*, 4*b* Fixed contact
5 Movable contact
6 Contact holder
7 Contact spring
10 Coil bobbin
11 Exciting coil
12 Fixed core
12*a* Shaft portion
12*b* Plate portion
13 Magnetic yoke
13*a* Bottom plate portion
13*b* Cylindrical portion
13*c* Flange portion
14 Movable core
15*c*, 15*d* Guide member
15*e*, 15*f* Latching piece
16 Return spring

What is claimed is:

1. An electromagnetic switch, comprising:

an arc-extinguishing chamber receptacle;

a contact device having a pair of fixed contacts fixed to maintain a predetermined interval and a movable contact disposed to be connectable with the pair of fixed contacts, inside the arc-extinguishing chamber receptacle; and an electromagnetic device driving the movable contact, and including a cylindrical exciting coil, a fixed iron core passing through a center of the exciting coil, a magnetic yoke covering an outer side of the exciting coil, and a movable iron core facing the fixed core and the magnetic yoke and disposed in the arc-extinguishing chamber receptacle, wherein armature surfaces of the fixed core and the magnetic yoke are formed on a side of the contact device than the exciting coil, and the fixed iron core has a T-shape and includes a rod portion disposed in the exciting coil and immovably fixed thereto, and a plate portion covering a contact device side end portion of the exciting coil and fixed to a contact device side end portion of the rod portion so that when the exciting coil is excited, the movable iron core is attracted to the plate portion and is moved only in the arc-extinguishing chamber.

2. An electromagnetic switch according to claim 1, wherein three or more armature surfaces are formed on the fixed iron core and the magnetic yoke.

3. An electromagnetic switch according to claim 1, wherein the magnetic yoke has two or more facing plate portions facing at least two end portions of the plate portion of the fixed iron core across a magnetic gap.

4. An electromagnetic switch according to claim 3, wherein the facing plate portions of the magnetic yoke are covered by a non-magnetic member.

5. An electromagnetic switch according to claim 4, wherein the non-magnetic member is the arc-extinguishing chamber receptacle.

6. An electromagnetic switch according to claim 1, wherein the movable iron core is urged to the side of the contact device by a return elastic body, and guided ascendably and descendably by a guide member, and a contact holder holding the movable contact is formed.

7. An electromagnetic switch, comprising:

an arc-extinguishing chamber receptacle;

a contact device having a pair of fixed contacts fixed to maintain a predetermined interval and a movable contact disposed to be connectable with the pair of fixed contacts, inside the arc-extinguishing chamber receptacle; and an electromagnetic device driving the movable contact, and having a cylindrical exciting coil, a fixed iron core passing through a center of the exciting coil, a magnetic yoke covering an outer side of the exciting coil, and a movable iron core disposed in the arc-extinguishing chamber receptacle and facing the fixed core and the magnetic yoke, wherein armature surfaces of the fixed core and the magnetic yoke are formed on a side of the contact device than the exciting coil, the fixed iron core has a T-shape and includes a rod portion disposed in the exciting coil and immovably fixed thereto, and a plate portion immovable disposed over the exciting coil and connected to a contact device side end portion of the rod portion, and the magnetic yoke has two facing plate portions disposed above the exciting coil and horizontally arranged with respect to the plate portion to be spaced from two end portions of the plate portion of the fixed iron core with a magnetic gap therebetween.

8. An electromagnetic switch according to claim 7, wherein the movable iron core is disposed above the immovable plate portion to be movable thereto.

* * * * *

UNITED STATES PATENT AND TRADEMARK OFFICE

CERTIFICATE OF CORRECTION

PATENT NO. : 8,570,125 B2
APPLICATION NO. : 13/519782
DATED : October 29, 2013
INVENTOR(S) : Kenji Suzuki et al.

It is certified that error appears in the above-identified patent and that said Letters Patent is hereby corrected as shown below:

In the Specifications

Please change column 1, line 41, “a cylindrical, portion” to --a cylindrical portion--.

Please change column 7, line 14 to 15, “fixed core of” to --fixed core 12 of--.

Signed and Sealed this
Twenty-fifth Day of March, 2014

Michelle K. Lee

Michelle K. Lee
*Deputy Director of the United States Patent and Trademark Office*